US006008708A

United States Patent [19]

Endoh et al.

[11] Patent Number: 6,008,708

[45] Date of Patent: Dec. 28, 1999

[54] REED RELAY AND METHOD FOR FABRICATION THEREOF

[75] Inventors: Tomohisa Endoh, Nagano; Tsutomu Motoyama, Kamiminochi, both of Japan

[73] Assignee: Fujitsu Takamisawa Component Limited, Tokyo, Japan

[21] Appl. No.: 09/271,246

[22] Filed: Mar. 17, 1999

Related U.S. Application Data

[62] Division of application No. 08/748,578, Nov. 13, 1996, Pat. No. 5,903,202.

[30] Foreign Application Priority Data

Jul. 16, 1996 [JP] Japan ..... 8-185920

[51] Int. Cl.[6] ..... H01H 1/66

[52] U.S. Cl. ..... 335/151; 335/154; 336/205; 336/208; 29/622

[58] Field of Search ..... 335/151, 154, 335/152, 255; 29/622; 361/162; 336/205, 208

[56] References Cited

U.S. PATENT DOCUMENTS

| | | | |
|---|---|---|---|
| 3,575,678 | 4/1971 | Barton | 335/151 |
| 3,760,311 | 9/1973 | Zimet et al. . | |
| 3,940,722 | 2/1976 | Fox et al. | 335/151 |
| 4,112,478 | 9/1978 | Takahasi et al. . | |
| 4,136,321 | 1/1979 | Smith | 335/151 |
| 4,701,735 | 10/1987 | Hill et al. | 335/282 |
| 4,908,593 | 3/1990 | Fox et al. . | |
| 5,438,307 | 8/1995 | Chou . | |
| 5,903,202 | 5/1999 | Endoh et al. | 335/151 |

*Primary Examiner*—Lincoln Donovan
*Assistant Examiner*—Tuyen T. Nguyen
*Attorney, Agent, or Firm*—Staas & Halsey LLP

[57] ABSTRACT

A reed relay comprising a reed switch having a pair of leads and a magnetic coil assembly for driving the reed switch, the magnetic coil assembly being composed of a magnetic coil wound around a cylindrical bobbin having an insulating flange at each end of the cylindrical bobbin, a terminal insulator integrally continuous with each flange, and a plurality of terminal leads insulated from one another by each of the terminal insulators. One embodiment of the present invention is a cylindrical bobbin having an electric conductivity so as to act as an electrostatic shield for the reed switch inserted thereinto, and another embodiment of the present invention is a method for fabricating the magnetic coil assembly comprising a step of forming a cylindrical bobbin and the terminal leads in each side of the cylindrical bobbin by using a patterned sheet of metal, wherein the cylindrical bobbin is continuous with the ground terminal lead in each side.

5 Claims, 3 Drawing Sheets

REED RELAY AND METHOD FOR FABRICATION THEREOF

This is the divisional of Ser. No. 08/748,578 filed Nov. 13, 1996 now U.S. Pat. No. 5,903,202.

FIELD OF THE INVENTION

This invention relates to a reed relay having a reed switch and a coil assembly for switching the reed switch, particularly to a structure and fabrication method of the coil assembly having a coil bobbin into which the reed swatch is inserted.

DESCRIPTION OF THE PRIOR ART

An example of a conventional reed relay is shown in FIG. 1, consisting of a reed switch 3 having leads 31 and a coil assembly 1 having a cylindrical static shield of metal 4. The cylindrical static shield 4 is inserted into a through hole 11 of a coil bobbin of resin 12 and fixed to the central one of terminal leads 14 at both ends of the coil bobbin 12 by spot welding where the terminal lead 14 is to be grounded. A pair of flanges 13 and terminal isolations 17 are formed by insert and to fix with both ends of the coil bobbin 12, around which a coil wire is wound to form a magnetic coil 2 as shown by a partial cutout view. Thus, the reed switch 3 is inserted in the cylindrical static shield 4, where the leads 31 and ends of the coil wire are fixed to terminal leads 15 and 16 at both outsides of the flanges by soldering, respectively. The reed switch 3 makes a contact close (or ON) by a magnetic force exerted by the magnetic coil 2 while a current flows in the magnetic coil 2, in which the cylindrical static shield 4 prevents the reed switch 3 from being erroneously driven by external electric noises. In the conventional reed relay as described above, the use of so many parts and components manufactured separately incurs much material costs and processing costs to assemble them into a complete set of the reed relay. Further, considerable spatial clearances are needed between the reed switch 3 and the cylindrical static shield of metal 4 and also between the cylindrical static shield of metal 4 and the coil bobbin 12, respectively, which results in inefficient occupancy in space, of which increases a total volume of the reed relay if the number of coil turns are maintained constant or decreases the number of the coil turns if the total volume is maintained as a constant. The highest efficiency in driving characteristics is usually attained when the reed contact is aligned to the center of the coil bobbin 12. However, it is difficult to align the reed contact to the desired position in the axial direction of the coil bobbin 12 if the reed contact is simply cut into a certain length. These drawbacks are structurally unavoidable in the conventional reed relay.

SUMMARY OF THE INVENTION

An object of the present invention is to provide a reed relay having an increased coil space to generate the highest possible magnetic force without increasing the total volume of the reed relay.

Another object of the present invention is to provide a reed relay having a monolithic structure of a coil bobbin composed of a cylindrical static shield and a plurality of terminal leading to simplifying the assembly processing steps.

A further object of the present invention is to provide a reed relay having a self aligning structure of a reed switch to the right position in a coil bobbin such that the highest efficiency in driving characteristics is always attained.

BRIEF DESCRIPTION OF THE DRAWINGS

The present invention will be more apparent from the following description, when taken to conjunction with the accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that these embodiments are not intended to limit the invention. On the contrary, the invention is intended to cover alternatives, modifications, and equivalents, which are included within the spirit and scope of the invention as defined by the appended claims.

Figure 2:
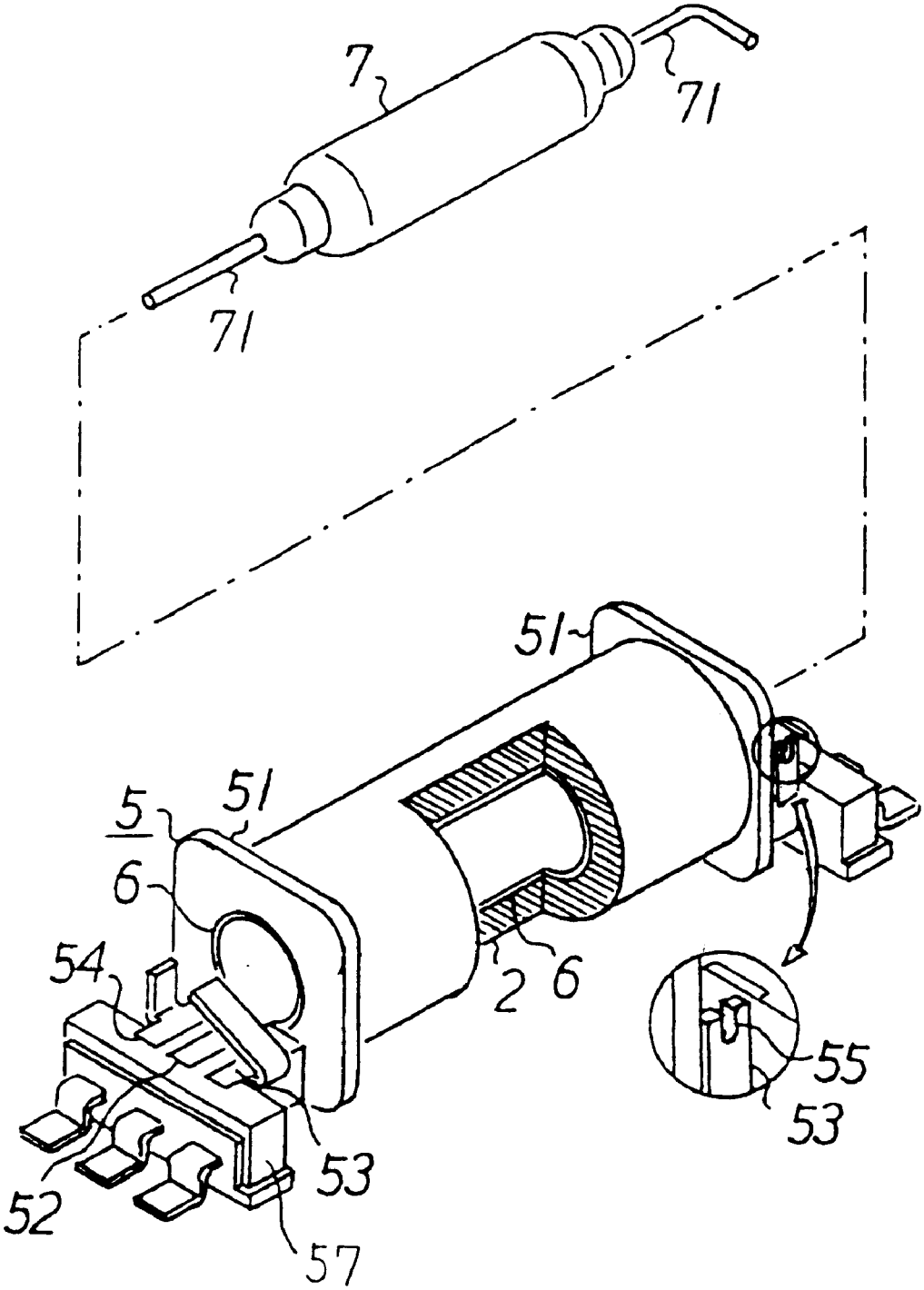
FIG. 2 is an exploded view having a partial cutout for a reed relay according to the present invention.

Referring to FIG. 2, a reed relay consists of a reed switch 7 having leads 71 and the coil assembly 5 having a monolithic coil bobbin 6 in which the reed switch 7 is inserted. The coil bobbin 6, usually made of copper, acts as a cylindrical static shield for the reed switch 7, and the coil bobbin 6 is integrally continuous with the first terminal leads 52 at both sides of the coil bobbin 6, which are to be grounded. The second, and third terminal leads 53, 54 are connected with each end of the coil wire, and each lead of the reed switch by soldering, respectively. These three terminal leads 52, 53, 54 are isolated from one another by terminal insulator 57. The coil bobbin of copper 6 has a pair of flanges 51 at both ends around which a magnetic coil 2 is directly formed as shown in a cutout view. The flanges 51 and terminal insulator 57 are simultaneously formed by insert molding. It should be noticed that one of the leads 71 of the reed switch 7 is bent in an L-shape at a certain position, which is engaged with a notch 55 formed in an end of one of the terminal leads 53 to be soldered. Another lead 71 is also soldered to the terminal lead 53 at the opposite side. The L-shaped terminal lead 53 enables a self-alignment of the reed contact to the right position in the magnetic coil where the maximum magnetic force is exerted.

Figure 1:
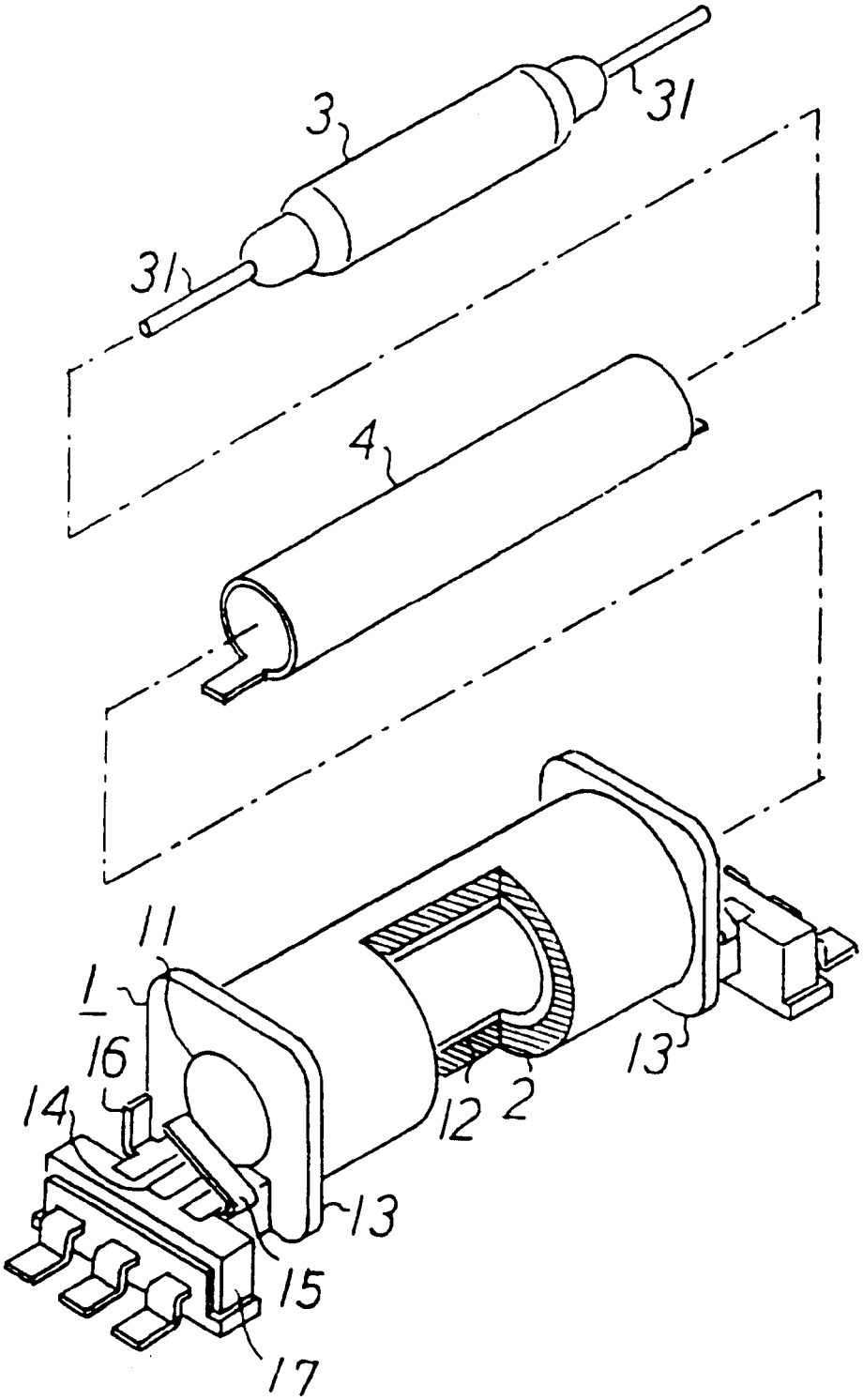
FIG. 1 PRIOR ART
FIG. 1 is an exploded view having a partial cutout for a conventional reed relay.
Figure 3A:
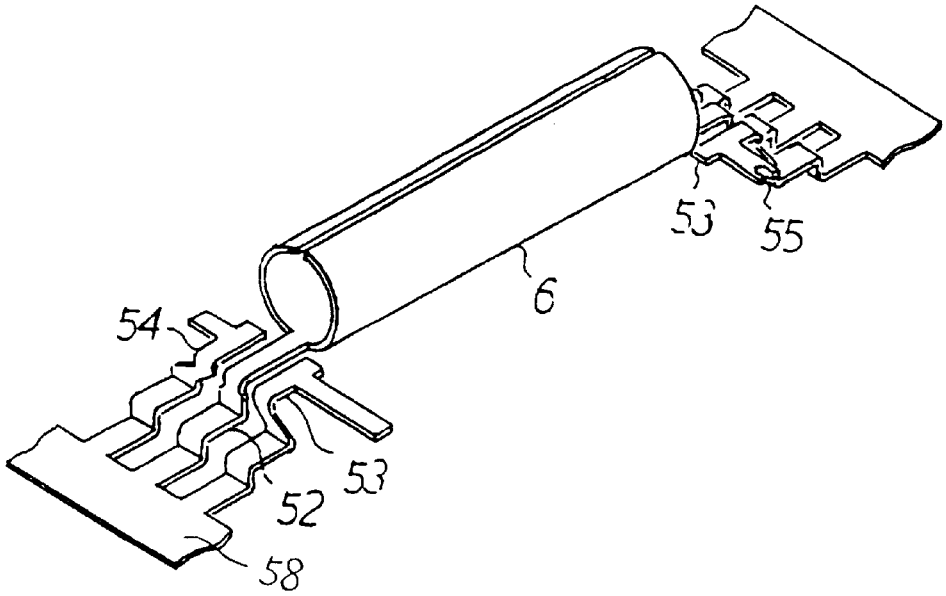
FIGS. 3A and 3B are perspective views of a monolithic structure of a coil bobbin and terminal leads with and without insert molded parts respectively, for the reed relay according to the present invention.

Referring to FIG. 3A, the monolithic coil bobbin 6, made of a continuous sheet of copper, is composed of a cylindrical part which is a cylindrical static shield, and terminal leads 52, 53, 54 supported by lead frames 58. The monolithic structure of the coil bobbin 6 as shown in FIG. 3A is originally provided by a patterned sheet of copper supported by parallel lead frames, which has a rectangular pattern for a coil bobbin and a plurality of terminal lead patterns in both sides of the rectangular pattern. The first step of the lead frame process is to curl the rectangular pattern into a cylindrical coil bobbin and deform the terminal lead patterns so as to fit the terminal insulators by pressing. Since the coil wire is directly wound around the cylindrical part of the coil bobbin 6 which also acts as a cylindrical electrostatic shield, the reed relay according to the present invention does not need as much clearance between the cylindrical static shield 4 and the coil bobbin 12 as in the prior art shown in FIG. 1.

This can save a considerable space for additional turns of the magnetic coil. One specific example shows that as much as 30% in numbers of coil turn increased. This results in lower power consumption of the magnetic coil or a smaller volume of the reed relay having the same magnetic force.

Figure 3B:
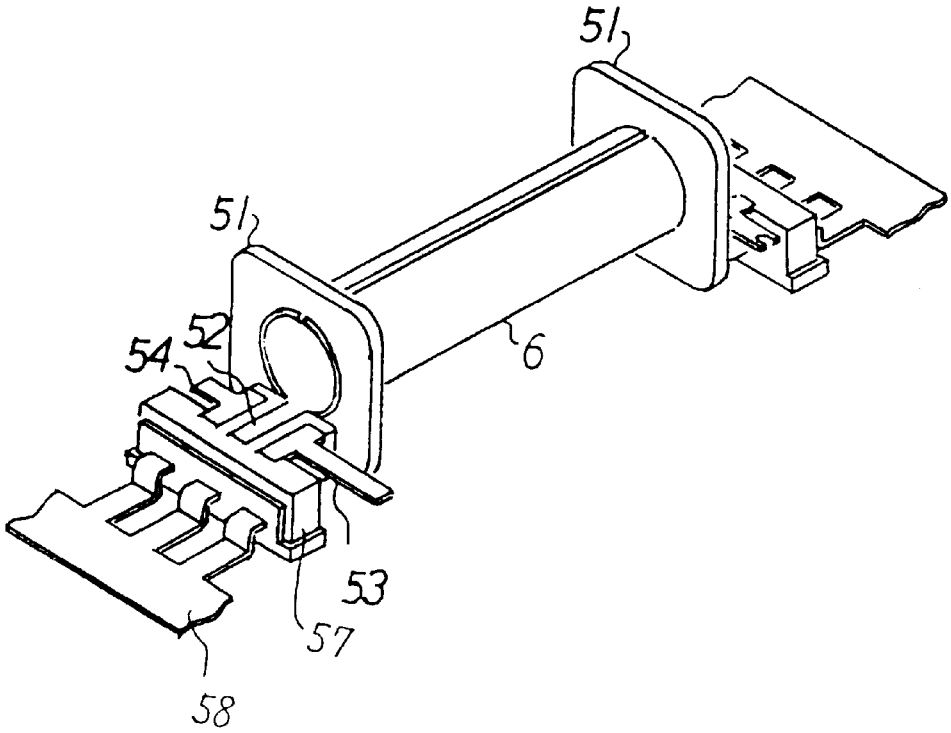

Referring to FIG. 3B, a pair of the flanges 51 and terminal insulators 57 are simultaneously formed by insert molding at both ends of the cylindrical part 6, around which an insulated coil wire is directly wound between the flanges 51. At a final stage, the terminal lead frames 58 are cut off to complete the magnetic coil assembly. Since the cylindrical part is continuously integrated with the terminal leads, unlike the prior art shown in FIG. 1, the processing step has become simple by which improvements in not only material and manufacturing costs but also reliability are expected.

What is claimed is:

1. A method for fabricating a reed relay having a magnetic coil assembly for driving a reed switch, the magnetic coil assembly including a bobbin formed of metal with a hole therethrough with opposite ends and respective insulating flanges at the opposite ends of the bobbin, the reed switch being inserted into the hole in the bobbin, a magnetic coil wound around the bobbin, terminal insulators connected to an exterior of each flange, and a plurality of terminal leads supported on and insulated from one another by the terminal insulators disposed at each of the opposite ends of the bobbin, with one of the terminal leads being integrally continuous with the bobbin, the bobbin being electrically conductive and functioning as an electrostatic shield for the reed switch, the method comprising the steps of:

providing a patterned metal sheet supported by parallel lead frames having a first pattern disposed between the parallel lead frames for forming the bobbin, and second and third patterns that extend toward each side of the first pattern from each of the parallel lead frames for forming the terminal leads, one of the terminal leads in each of said second and third patterns being continuous with each end of the first pattern such that the first pattern is supported between the second and third patterns;

curling the first pattern to form the bobbin; and forming pair of insulating flanges and terminal insulators outside the insulating flanges by insertion molding, such that one of the insulating flanges is fixed to each end of the bobbin and each of the terminal insulator insulates the terminal leads from one another, wherein the insulating flange and the terminal insulator are integrally continuous in each side of the bobbin.

2. A method for fabricating a reed relay according to claim 1, wherein a main component of the metal is copper.

3. A method for fabricating a reed relay according to claim 1, further comprising the steps of:

separating the second and third patterns with the bobbin from the parallel lead frames;

winding an insulated coil wire in multiple layers around the bobbin between the flanges;

connecting each of opposite ends of the insulated coil wire with one of isolated terminal leads in each end of the bobbin to supply current to the coil; and inserting a reed switch having a pair of opposite leads through the hole of the bobbin such that each of the opposite leads out of each end of the bobbin is electrically connected with one of isolated terminal leads of the coil assembly in each end of the bobbin to supply current to the reed switch.

4. A method for fabricating a reed relay according to claim 1, wherein the first pattern has a rectangular shape so as to form a cylindrical bobbin.

5. A method for fabricating a reed relay according to claim 4, wherein an internal diameter of the cylindrical bobbin is such that only the corresponding reed switch to be inserted into the hole of the bobbin.

* * * * *